US007438787B2

(12) United States Patent
Mizuno et al.

(10) Patent No.: US 7,438,787 B2
(45) Date of Patent: Oct. 21, 2008

(54) IMPRESSED CURRENT CATHODIC PROTECTION SYSTEM FOR MARINE ENGINE

(75) Inventors: Masahiro Mizuno, Shizuoka-ken (JP); Yuji Tateishi, Shizuoka-ken (JP); Toshiyuki Mizushima, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 139 days.

(21) Appl. No.: 11/388,932

(22) Filed: Mar. 24, 2006

(65) Prior Publication Data

US 2006/0213765 A1 Sep. 28, 2006

(30) Foreign Application Priority Data

Mar. 24, 2005 (JP) ..... 2005-085522

(51) Int. Cl.
*C23F 13/10* (2006.01)
*C23F 13/20* (2006.01)

(52) U.S. Cl. ..... 204/196.19; 204/196.18; 204/196.34; 204/196.37; 440/80; 440/88 C; 440/88 R

(58) Field of Classification Search ..... 204/196.18, 204/196.19, 196.34, 196.37; 440/80, 88 C, 440/88 R
See application file for complete search history.

(56) References Cited

U.S. PATENT DOCUMENTS

| | | | | |
|---|---|---|---|---|
| 3,953,742 | A * | 4/1976 | Anderson et al. | 204/196.03 |
| 6,319,080 | B1 * | 11/2001 | Watanabe et al. | 440/88 R |
| 6,559,660 | B1 * | 5/2003 | Staerzl | 324/712 |
| 7,131,877 | B1 * | 11/2006 | Staerzl | 440/76 |
| 2003/0232486 | A1 | 12/2003 | Mashino | 438/455 |
| 2004/0246656 | A1 | 12/2004 | Kirsten | 361/306.3 |

FOREIGN PATENT DOCUMENTS

| | | |
|---|---|---|
| JP | 06-299377 | 10/1994 |
| JP | 10-236390 | 9/1998 |

* cited by examiner

*Primary Examiner*—Bruce F Bell
(74) *Attorney, Agent, or Firm*—Knobbe Martens Olson & Bear LLP

(57) ABSTRACT

A cathodic protection system has electrodes disposed in a coolant passage of an engine filled with a conductive coolant. The electrodes are electrically insulated from the engine. A power supply device provides for a protective electric current to form from the electrodes to the engine through the coolant. The cathodic protection system reduces engine manufacturing and maintenance costs and provides an anticorrosive effect without increasing the size of the engine.

20 Claims, 10 Drawing Sheets

IMPRESSED CURRENT CATHODIC PROTECTION SYSTEM FOR MARINE ENGINE

RELATED APPLICATIONS

The present application is based on and claims priority under 35 U.S.C. § 119(a)-(d) to Japanese Patent Application No. 2005-085522, filed on Mar. 24, 2005, the entire contents of which are hereby expressly incorporated by reference herein.

BACKGROUND OF THE INVENTION

1. Field of the Invention

The present invention relates to an impressed current cathodic protection system for a marine engine. Preferably, the protection system provides a protective current flow through a coolant passage.

2. Description of the Related Art

A conventional outboard motor engine often uses seawater as a coolant and may be subject to cathodic corrosion due to the seawater contacting the inner wall of its coolant passages. In order to inhibit cathodic corrosion, an anticorrosive coating commonly is applied to an inner surface of at least some of the coolant passages within the engine. The anticorrosive coating may be applied by painting the coating on an inner wall of the coolant passage. The anticorrosive coating applied within the coolant passages may come off after the engine has been in service for a long period of time. Once the coating comes off, the coating no longer inhibits corrosion.

In some outboard motors, a cathodic protection system is used to inhibit electrolytic corrosion. For example, a corrosion protection system may use a sacrificial electrode or anode in the shape of a bar. The anode may be detachable from a cylinder head with its electrode facing an internal space of the coolant passage.

At least two types of sacrificial anodes often are used for conventional outboard motor engines. The first type of anode is externally attached to/detached from the engine while the other type of anode is internally attached to/detached from the engine. Self-corrosion of the anode produces a protective current which causes the anode to be consumed. The consumption of the anode creates a need for replacement before the anode is completely consumed.

The residual current of the anode is measured periodically or at the time of engine maintenance and, if necessary, the anode is replaced. The anode can also be visually inspected to determine whether replacement is required. To visually inspect the residual anode, the anode is removed from the engine or the engine is disassembled.

A disadvantage of this system is that part of the internal space of the coolant passage is used for setting the anodes. For anodes designed to be externally attached to/detached from the engine, a dedicated mounting seat on the external surface of the engine also must be provided. In addition, each anode is only effective over a limited area, and thus multiple anodes may be required for complete protection. An engine equipped with a cathodic prevention system that uses the aforementioned anodes tends to be larger. The extra assembly step of attaching the anode also increases manufacturing costs. Further, the measurement of the residual anode current and the replacement of the anodes increase maintenance costs.

Known impressed cathodic protection systems utilize an anticorrosive electrode in the coolant passage and more specifically on the upstream side of the engine. See, e.g. Japanese Publication No. 06-299377, dated Oct. 25, 1994. The anticorrosive electrode provides an anticorrosive effect to an area adjacent to the anticorrosive electrode; the anticorrosive effect is limited for other areas of the coolant passages through the engine, especially at the more narrow passages.

SUMMARY OF THE INVENTION

An aspect of the present invention is directed toward addressing one or more of these problems and provides a cathodic protection system that has an anticorrosive effect without increasing the engine size and that can reduce engine manufacturing and maintenance costs. Preferably, the impressed current cathodic protection system has a plurality of electrodes disposed in a coolant passage of the engine filled with a conductive coolant. The electrodes are electrically insulated from the engine and power is supplied to the electrodes by a power supply device. The powered electrodes provide a protective current to the engine through the coolant.

Another aspect is an impressed current cathodic protection system for a marine engine having a coolant passage, the coolant passage being configured to receive a conductive coolant. The system comprises a plurality of electrodes disposed in the coolant passage, each electrode being electrically insulated from the engine and a power supply configured to provide a protective current between the plurality of electrodes and the engine via the conductive coolant.

Another aspect is a marine engine that comprises a coolant passage configured to receive a conductive coolant, a plurality of electrodes disposed in the coolant passage and electrically insulated from the engine, and a power supply configured to supply an electric potential to the plurality of electrodes and the engine.

Yet another aspect has at least one electrode in a linear form and bent to conform to a shape of the coolant passage. Another aspect has at least one of the electrodes in a loop form with part of the electrode connected to the power supply device. Another aspect has the electrodes arranged side by side. Another aspect has a circuit that automatically shuts off one of the plurality of electrodes upon the occurrence of a short circuit to the one of the plurality of electrodes. Another aspect has a switch which disconnects power to the electrode when the engine is stopped. Another aspect has an abnormality detection circuit for detecting an abnormality in the power supply to the electrodes. Yet another aspect has an alarm for producing a visible and/or audible alarm in response to the detection of an abnormality.

In a preferred form, a protective current flows from electrodes disposed in the engine and through a wall of the coolant passage in the engine. The current can inhibit cathodic corrosion in the engine. Unlike a sacrificial electrode, the electrodes do not readily wear out, and thus are less likely need replacing. The service life of the electrode may be longer than the service life of a sacrificial electrode. This longer service life may reduce maintenance costs compared to a conventional cathodic protection system that employs sacrificial electrodes.

Because easy access to the electrodes of the present invention is not necessary, the electrodes may be installed within the engine. By installing the electrodes within the engine and not on the engine, the size of the engine is not increased.

An additional aspect of the invention is to disable the electrodes when an abnormality occurs to the electrodes. Another aspect is to reduce the flow of protective current without creating significant fluctuations in the protective current (current value) if an insulating coating is formed on the wall of the coolant passage. Under these conditions, any reduction in corrosion protection is minimized.

An aspect of the invention is to form the electrodes to approximately conform to the complicated shapes of the coolant passages in the engine. Thus, the coolant passages through which the electrodes pass are subject to a stable protective potential regardless of the shape of the passage.

A further aspect of the cathodic protection system employs a loop-type electrode. By keeping the loop energized, the reliability of the impressed current cathodic protection system is improved. Another aspect includes an anticorrosive electrode that is divided into two portions with both portions being connected to the power supply device. Conductivity tests on both portions determine whether a break may have occurred in the electrode. Another aspect of the cathodic protection system includes providing two side by side electrodes so that if one of the electrodes is not operational, the other electrode provides corrosion protection to the engine.

An aspect of the cathodic protection system includes a power supply that automatically stops providing a protective current to a short-circuited electrode while still providing the protective current to the other electrodes. The power supply minimizes the size of the region affected by the short circuit and improves the reliability of the impressed current cathodic protection system.

An additional aspect of the cathodic protection system is to provide redundant electrodes disposed at the same position so if a first electrode shorts out, the second electrode provides the protective current.

Another aspect of the cathodic protection system turns the power on and off depending on the operation of the engine. For example, when seawater is flowing within the coolant passages and the engine is on, the power supply is ON to the anticorrosive electrodes. When the engine stops and a majority of the coolant is drained out of the engine, the power supply to the anticorrosive electrodes is OFF and reduces power consumption.

The systems and methods of the invention have several features, no single one of which is solely responsible for its desirable attributes. Without limiting the scope of the invention as expressed by the claims which follow, its more prominent features have been discussed briefly above. After considering this discussion, and particularly after reading the section entitled "Detailed Description of the Preferred Embodiments" one will understand how the features of the system and methods provide several advantages over conventional corrosion protection systems.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

FIG. 5(*b*) is an enlarged view of a portion of the anticorrosive electrode from FIG. 5(*a*).

DETAILED DESCRIPTION OF THE PREFERRED EMBODIMENTS

The following detailed description is now directed to certain specific embodiments of the invention. However, the invention can be embodied in a multitude of different systems and methods. In this description, reference is made to the drawings wherein like parts are designated with like numerals throughout.

Figure 1:
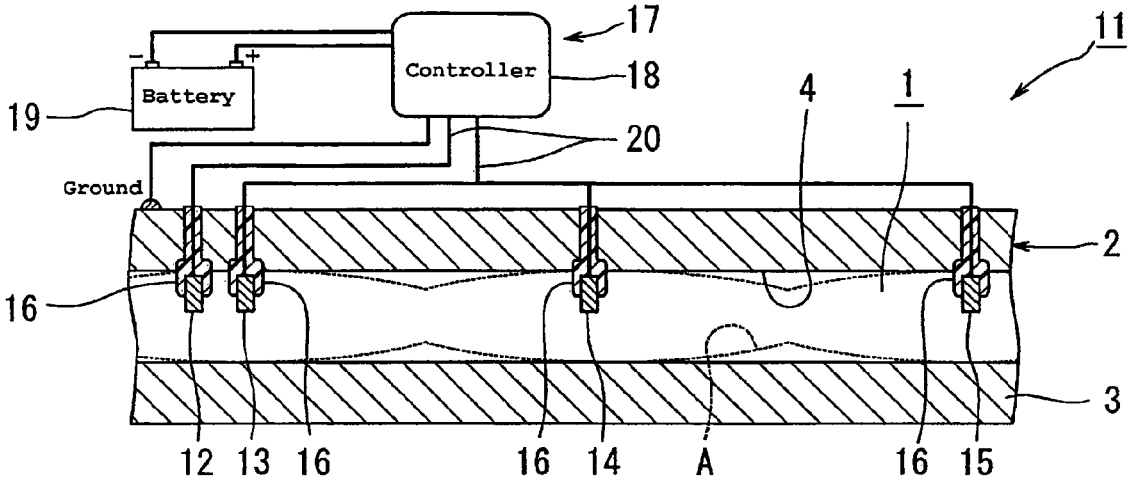
FIG. 1 is a schematic cross-section of an impressed current cathodic protection system according to the invention.

FIG. 1 is a schematic cross-section of an impressed current cathodic protection system 11 for use with a marine engine 2. While the protection system 11 is described in connection with a marine engine, the protection system 11 also may be used with other types of engines.

The engine 2 includes a cylinder body 3 and a coolant passage 1 disposed within the cylinder body 3. The cylinder body 3 may be made from an aluminum alloy. The coolant passage 1 may be designed for seawater coolant.

The impressed current cathodic protection system 11 includes electrodes 12, 13, 14, 15 attached through insulating support members 16 to a wall 4 of the coolant passage 1. The impressed current cathodic protection system 11 further includes a power supply device 17 configured to apply a protective current to the coolant flowing in the internal space of the coolant passage 1 via the electrodes 12, 13, 14, 15. The power supply device 17 includes a controller 18 and a battery 19 for supplying power to the controller 18. The power supply device 17 illustrated in FIG. 1 employs a potential control method.

The electrodes 12 to 15 may have a cylindrical shape and be connected to the controller 18 through lead wires 20. The electrodes 13 to 15 are spaced at a specified distance from each other along the wall 4. Support members 16 support the electrodes 12 to 15 and may comprise rubber or plastic. Preferably, the rubber or plastic has heat resistance and insulation properties.

The electrode 12 positioned leftmost in FIG. 1 is a reference electrode for the controller 18. The other anticorrosive electrodes 13 to 15 are configured to apply a protective current to the coolant in the internal space of the coolant passage 1 such that a value of the protective current generally corresponds to a potential measured by the reference electrode 12. The anticorrosive electrodes 13 to 15 are disposed with specified gaps so that any area of the internal space in the coolant passage 1 receives an anticorrosive effect. A broken line A indicates that the anticorrosive effect is available throughout the internal space in the coolant passage 1.

In the impressed current cathodic protection system 11 illustrated in FIG. 1, a protective current flows from the anticorrosive electrodes 13 to 15 disposed in the internal space of the coolant passage 1 and through the inner wall 4 of the cylinder body 3 to protect the engine 2 from cathodic corrosion.

Unlike conventional sacrificial electrodes, the anticorrosive electrodes 12 to 15 only provide a protective current and therefore do not readily wear out. Thus, the anticorrosive electrodes 13 to 15 may not need to be replaced. The service life for the electrodes 12 to 15 may be longer than the service life of sacrificial electrodes.

As described above, the anticorrosive electrodes 13 to 15 may not need to be replaced. Unlike electrodes 12 to 15, conventional sacrificial electrodes are attached externally to the engine 2 to allow the sacrificial electrodes to be easily replaced. Thus, an engine 2 employing the cathodic protection system 11 does not increase in size even if the cathodic protection system 11 includes a plurality of anticorrosive electrodes since the electrodes may be installed internal to the engine 2.

Figure 2:
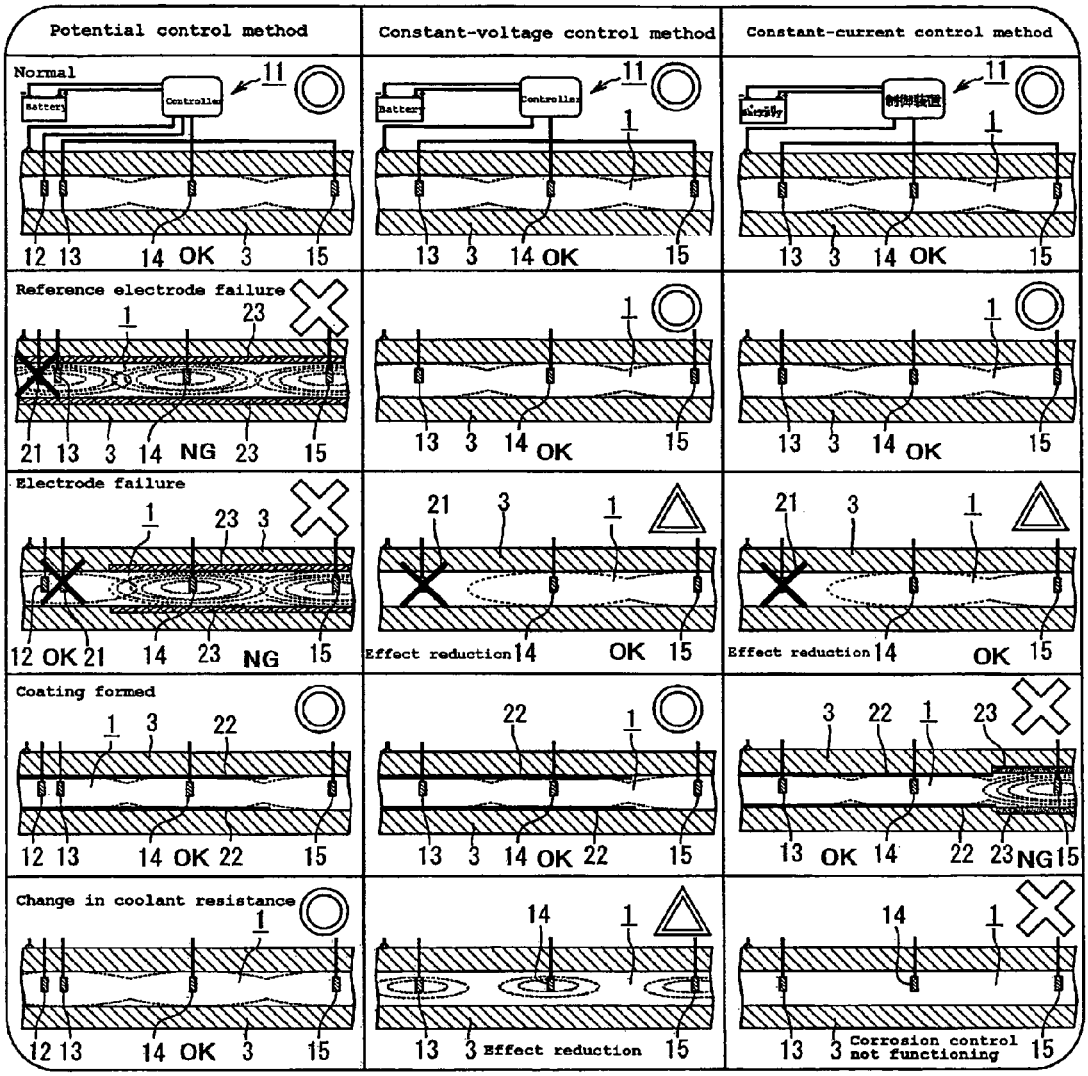
FIG. 2 illustrates various conditions, including failure conditions, which may occur for each of the three power supply methods.

FIG. 2 illustrates various conditions, including a failed electrode 21, which may occur for three different power supply methods. The three control methods are arranged in columns with the different abnormities arranged in rows. Instead of the potential control method employed by the power supply device 17 illustrated in FIG. 1, the cathodic protection system 11 may use a constant-voltage control method or a constant-current control method to energize the electrodes 13 to 15. A cathodic protection system 11 using the constant-voltage control method or the constant-current control method does not require a reference electrode 12.

When using the constant-voltage control method, a malfunctioning electrode 13 to 15 may cause insignificant fluctuations in the current value of the protective current and reduce the area subject to the protective current. The malfunction of an electrode 13 to 15 may be caused by the formation of an insulating coating 22, such as aluminum oxide film, on the inner wall of the coolant passage 1.

For an engine 2 employing the constant-voltage control method on a lake, the increase in coolant resistance decreases the protective current and the anticorrosive effect. However, the fresh water in the lake inhibits cathodic corrosion. Accordingly, the reduced anticorrosive effect has limited impact on the engine 2. For the aforementioned failures, the constant-voltage control method may minimize any adverse impact on the corrosion protection provided by the cathodic protection system 11.

When using the constant-current control method, a malfunctioning electrode 13 to 15 may reduce the area subject to the protective current and the corrosion protection. The formation of an insulating coating 22 on the inner wall of the coolant passage 1 may concentrate an excessive amount of protective current at the remaining uncovered regions 23. The inner wall 4 of the coolant passage 1 may become subjected to corrosion. In the constant-current control method, an increase in the resistance of the coolant prevents the protective current from flowing and the corrosion protection.

When using the potential control method, the corrosion control does not work when the reference electrode 12 or the anticorrosive electrodes 13 to 15 malfunction 21 as illustrated in FIG. 2.

Figure 3:
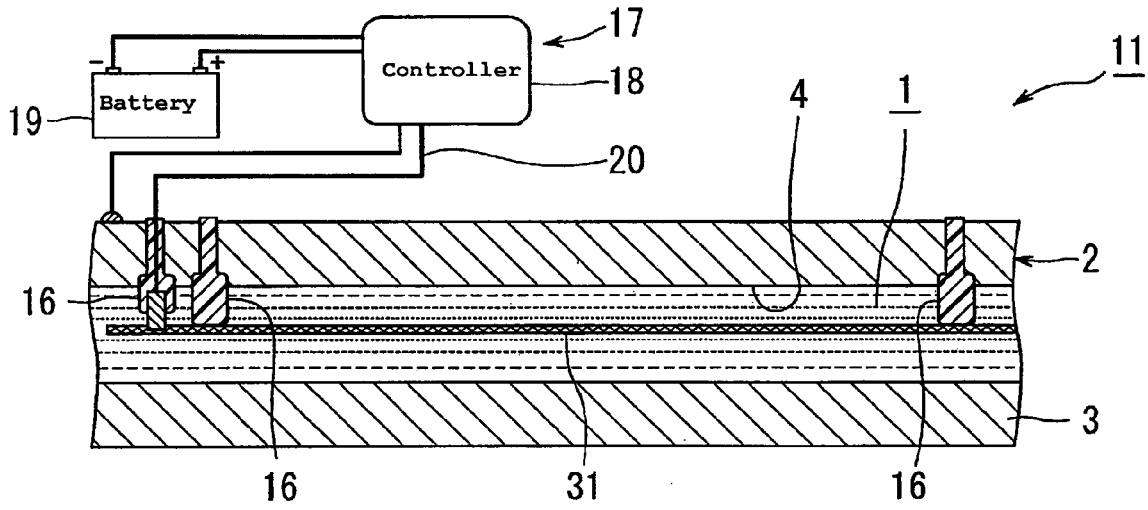
FIG. 3 is a cross-section of another embodiment of an impressed current cathodic protection system.

FIG. 3 is a cross-section of another embodiment of an impressed current cathodic protection system 11 having a linear electrode 31. The linear electrode 31 is in a linear form and may include a coated electrode wire. The electrode wire may have a platinum electrode or a flexible copper wire as a core. The electrode wire may be made by applying a protective coating of titanium, niobium or tantalum to the flexible copper wire, and then plating platinum to the external surface of the protective coating. Platinum, a principal component of the platinum plating, has high conductivity and is insoluble in an electrolyte. Application of the platinum plating to the core wire results in the electrode wire having high anticorrosive properties.

The coating may be formed by twisting a plastic string, which has both heat resistance and insulation properties, to create an elongated cylinder in the shape of a bag. The coating may be made of fluoro-plastics. The electrode wire passes through the cylindrical coating. The twisted string inhibits direct contact between the electrode coated wire and the engine 2 so as to prevent a short circuit from occurring when the electrode wire is in contact with the coolant.

Figure 4:
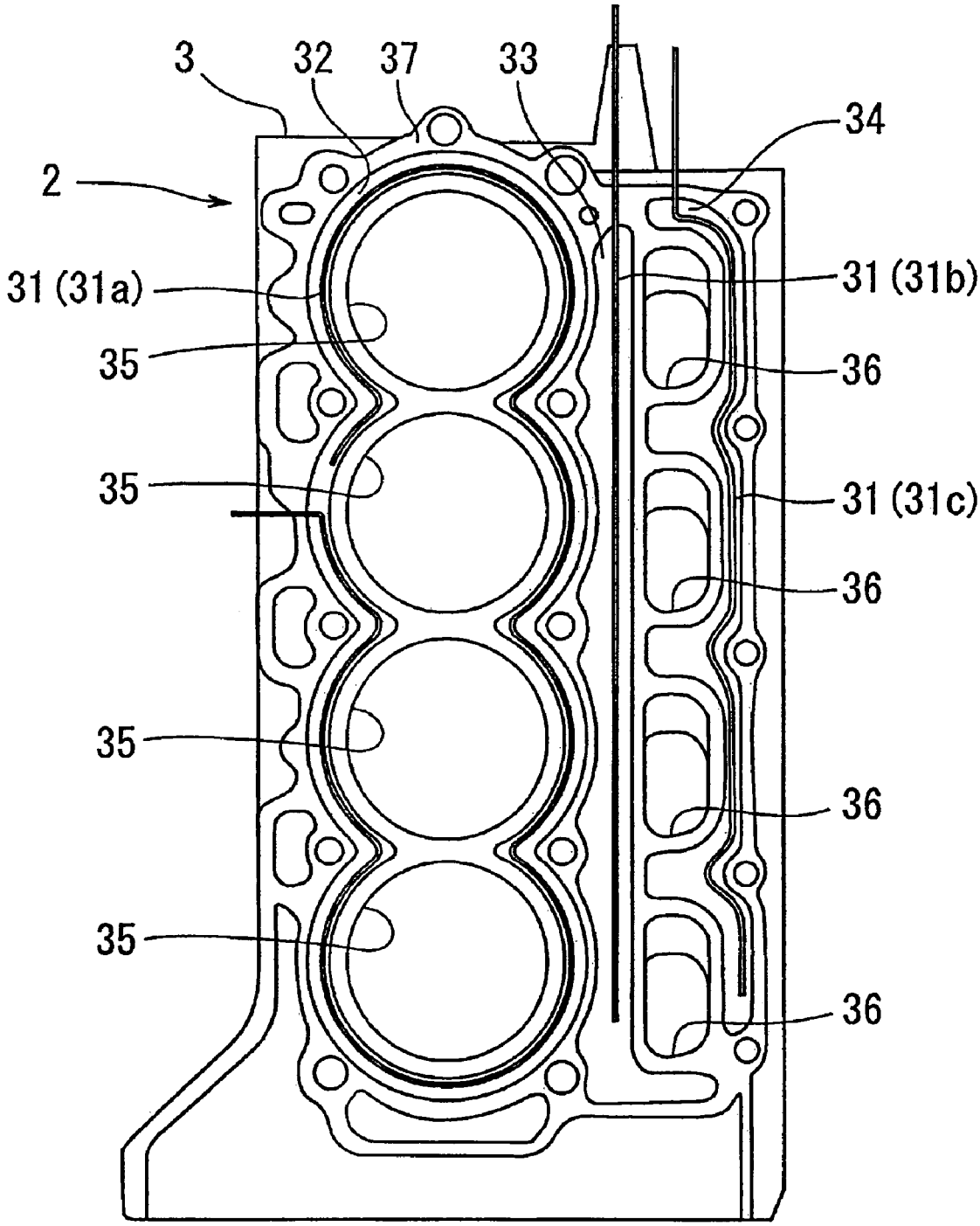
FIG. 4 is a plan view of a marine engine having an impressed current cathodic protection system with linear electrodes.

FIG. 4 is a plan view of a marine engine 2 having an impressed current cathodic protection system 11 according to FIG. 3 with a plurality of linear electrodes 31*a*, 31*b*, 31*c*. The cylinder body 3 is a four-cylinder engine having first, second and third coolant passages 32, 33, 34. The first coolant passage 32 surrounds the bores 35 of the cylinder body 3. The second coolant passage 33 is defined between the cylinder bores 35 and exhaust ports 36. The third coolant passage 34 surrounds the exhaust ports 36 externally. The linear anticorrosive electrodes 31*a*, 31*b*, 31*b* pass through the first, second and third coolant passage 32, 33, 34, respectively.

A mating face 37 of the cylinder body 3 is configured to mate with a cylinder head (not shown). The coolant passages 32 to 34 are open in a direction toward the cylinder head. Coolant passages in the cylinder head connect with the coolant passages 32 to 34 of the cylinder body 3 when the cylinder head is fixed to the cylinder body 3.

The first anticorrosive electrode 31*a* passes through the first coolant passage 32 surrounding the cylinder bores 35. The shape of the electrode 31*a* may be selected to conform to the shape of the internal space within the first coolant passage 32. The anticorrosive electrode 31*a* may be formed in one stroke so as to thoroughly enclose the opening edge of the first coolant passage 32.

The second coolant passage 33 extends in a direction that is parallel to the cylinder bores 35. As illustrated in FIG. 4, the anticorrosive electrode 31*b* extends through the second coolant passage 33.

The third coolant passage 34 surrounds the exhaust ports 36. The shape of the anticorrosive electrode 31*c* may be selected to conform to the shape of the opening edge of the third coolant passage 34.

As shown in FIG. 4, the ends of the first, second, and third anticorrosive electrodes 31*a*, 31*b*, 31*c* extend through the cylinder body 3 and outside of the engine 2. The external ends of the electrodes 31*a*, 31*b*, 31*c* are connected to the controller 18 for receiving power from the battery 19. As shown in FIG. 3, support members 16 hold the anticorrosive electrodes 31*a*, 31*b*, 31*c* within the coolant passage 1. The lead wire 20 may extend through the support member 16 and connects to the controller 18.

To facilitate connecting the internal anticorrosive electrodes 31 to the controller 18, an electrode lead-out member (not shown) may be employed in the cylinder body 3 or cylinder head. One or more of the electrodes 31 passes through the electrode lead-out members between the inside and outside of the engine 2. A sealing member between the electrode 31 and the lead-out member may be employed to prevent coolant from leaking through the lead-out member.

The embodiment of the cathodic protection system 11 illustrated in FIGS. 3 and 4 may employ any one of the three power supply methods described above with reference to FIG. 2.

In the impressed current cathodic protection system 11 illustrated in FIGS. 3 and 4, the linear anticorrosive electrodes 31*a* to 31*c* are formed so as to approximately conform to the complicated shapes of the coolant passages 1, 32, 33, 34 and inhibit corrosion of the engine 2. Thus, the coolant passages through which the anticorrosive electrodes 31*a* to 31*c* pass experience a stable protective potential regardless of the shape of the coolant passage.

Each linear anticorrosive electrode 31*a*, 31*b*, 31*c* may be held in place at one or more locations along the electrode. For conventional cathodic protection systems, the bar-shaped sacrificial electrodes require additional space for their attachment to the engine 2. The cathodic protection system 11 illustrated in FIGS. 3 and 4 uses fewer anticorrosive electrodes 31 (31*a* to 31*c*) as compared to a conventional cathodic protection system of bar-shaped sacrificial electrodes.

The linear anticorrosive electrodes 31 may be used in combination with the cylindrical anticorrosive electrodes 13 to 15 illustrated in FIG. 1 or with conventional sacrificial electrodes. The combination of electrode types may provide more complete protection to the engine 2 or add coverage for regions of the coolant passages that the linear electrodes 31 have little effect. These regions may include any gaps between the cylinders on the coolant passage in the cylinder head and an internal portion of a coolant passage cover (not shown) on the cylinder body 3.

Figure 5:
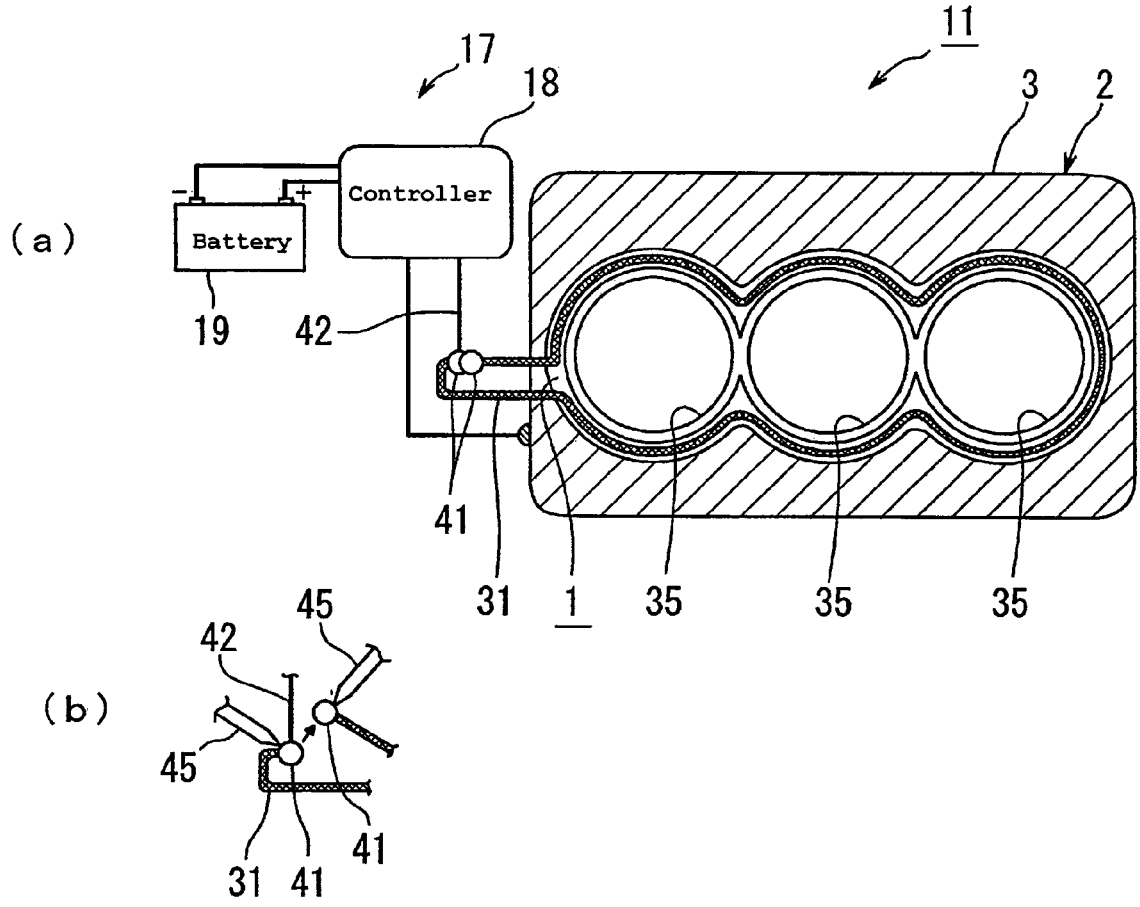
FIG. 5(*a*) is a schematic, cross-section of another embodiment of an impressed current cathodic protection system that includes a loop-type electrode.

FIG. 5(*a*) is a schematic, cross-section of another embodiment of an impressed current cathodic protection system 11 having an anticorrosive electrode 31 in a loop form. FIG. 5(*b*) is an enlarged view of the anticorrosive electrode 31 illustrated in FIG. 5(*a*). The anticorrosive electrode 31 shown in FIGS. 5(*a*) and 5(*b*) is a linear electrode similar to the linear electrode described above with reference to FIGS. 3 and 4 except that the linear electrode illustrated in FIGS. 5(*a*) and 5(*b*) is in a loop form. The anticorrosive electrode 31 shown in FIGS. 5(*a*) and 5(*b*) passes through the coolant passage 1 with part of the electrode 31 being connected to the power supply device 17. The coolant passage 1 surrounds the cylinder bores 35.

A portion of the anticorrosive electrode 31 shown in FIGS. 5(*a*) and 5(*b*) is external to the engine 2 and includes a dividing terminal 41. The power supply device 17 supplies power to the anticorrosive electrode 31 through a lead wire 42 connected to the dividing terminal 41.

As illustrated in FIG. 5(*b*), the dividing terminal 41 divides the anticorrosive electrode 31 into two portions: a first terminal 41 and a second terminal 41. To determine whether a break has occurred in the anticorrosive electrode 31, contacts 45 are provided to attach a conductive measurement tester (not shown) to the first and second terminals 41. With the terminals 41 external to the engine 2, the conductive measurement may advantageously be performed without disassembling the engine 2.

Figure 6:
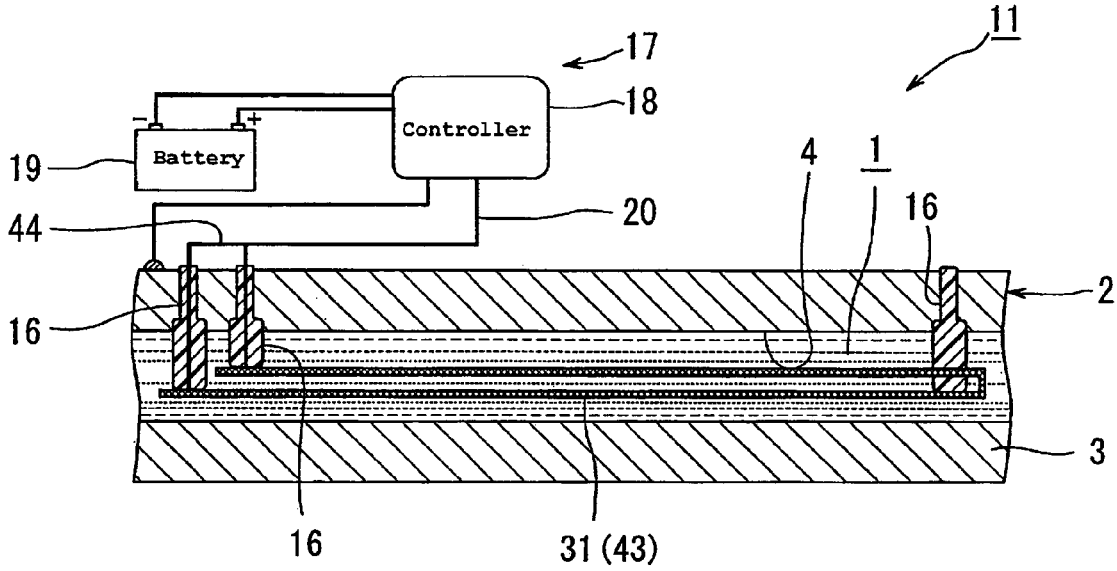
FIG. 6 is a schematic, cross-section of another embodiment of an impressed current cathodic protection system that includes a loop-type electrode.

FIG. 6 is a schematic, cross-section of an impressed current cathodic protection system 11 that includes a loop-type anticorrosive electrode 31. The anticorrosive electrode 31 of FIG. 6 is a loop-type electrode similar to the loop-type electrodes illustrated in FIGS. 5(*a*) and 5(*b*). The electrode 31 illustrated in FIG. 6 has a linear electrode body 43 passing through the coolant passage 1 and a lead wire 44 for connecting together both ends of the electrode body 43. The lead wire 44 is provided with a dividing terminal (not shown) that is equivalent to the dividing terminal 41 shown in FIGS. 5(*a*) and 5(*b*).

The anticorrosive electrodes 31 of the impressed current cathodic protection systems 11 illustrated in FIGS. 5(*a*), 5(*b*), and 6 are loop-type electrodes. Part of the electrodes 31 are connected to the power supply device 17 so that the electrodes 31 are kept thoroughly energized in the event a part of the loop is broken. Thus, the embodiments illustrated in FIGS. 5(*a*), 5(*b*), and 6 may have improved reliability over a non-loop type electrode.

The embodiments of the impressed current cathodic protection systems 11 illustrated in FIGS. 5(*a*), 5(*b*), and 6 may employ any of the power supply methods described above with reference to FIG. 2. The loop-type anticorrosive electrode 31 may be made from a flexible linear-type anticorrosive electrode 31 or made using a rigid member to form the anticorrosive electrode into a loop shape.

Figure 7:
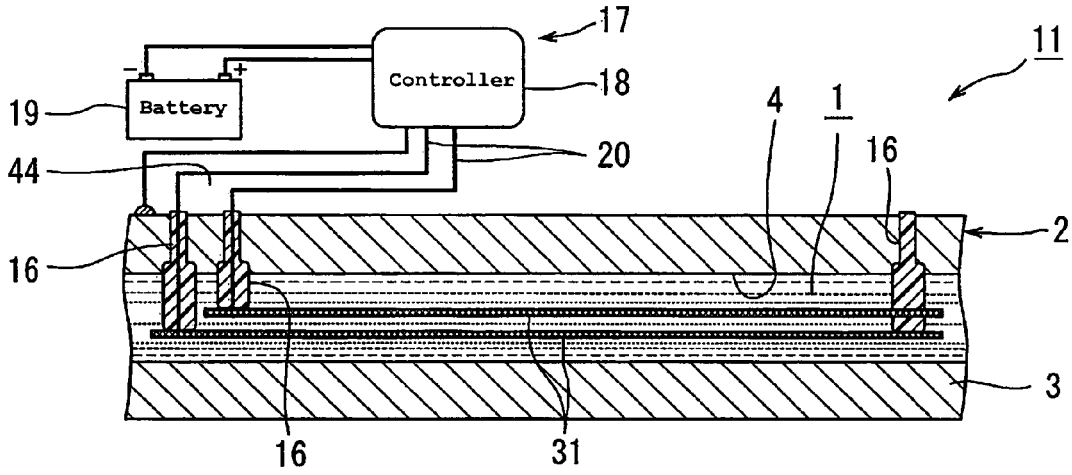
FIG. 7 is a schematic, cross-section of another embodiment of an impressed current cathodic protection system that includes two linear electrodes.

FIG. 7 is a schematic, cross-section of another embodiment of an impressed current cathodic protection system 11 that includes two linear electrodes 31. The two linear anticorrosive electrodes 31, 31 may be disposed at the same position in the internal space of the coolant passage 1. The anticorrosive electrodes 31 attach to a cylinder body 3 via support members 16. A controller 18 is connected to the ends of the electrodes 31 via lead wires 20.

The two anticorrosive electrodes 31 provide redundant corrosion protection. In the event one of the anticorrosive electrodes 31 can not be energized, the other energized electrode 31 prevents corrosion. Thus, the impressed current cathodic protection system 11 illustrated in FIG. 7 may have improved reliability.

In the event of a failure with the cathodic protection system 11 illustrated in FIG. 7, one of the linear, anticorrosive electrodes 31 may be used as a reference electrode to identify the cause of the failure. To identify the cause of the failure, a tester (not shown) may be connected to the lead wire 20 of the reference electrode 31 to measure the polarization potential.

To determine the cause of a failure for an engine having a conventional protection system, a mounting hole is drilled on the external wall of the cylinder body for receiving a reference electrode. In contrast, the cathodic protection system 11 illustrated in FIG. 7 does not require any drilling since one of the remaining electrodes 31 may be used as a reference electrode.

With the plurality of anticorrosive electrodes 31 illustrated in FIG. 7, the cathodic protection system 11 may employ any of the three power supply methods described above with reference to FIG. 2. If the potential control method is selected, a tester may be connected to one of the anticorrosive electrodes 31 as the reference electrode 12 and also connected to one of the other anticorrosive electrode 31 to measure the polarization potential.

Figure 8:
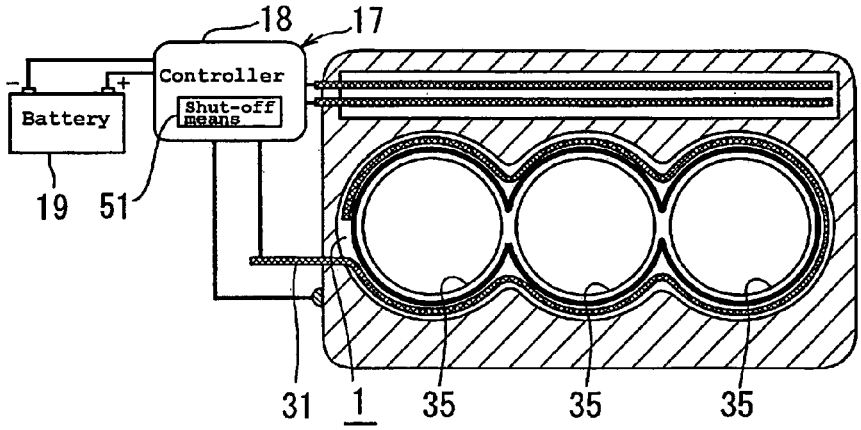
FIG. 8 is a block diagram illustrating another embodiment of the impressed current cathodic protection system that includes redundant or plural electrodes.
Figure 9:
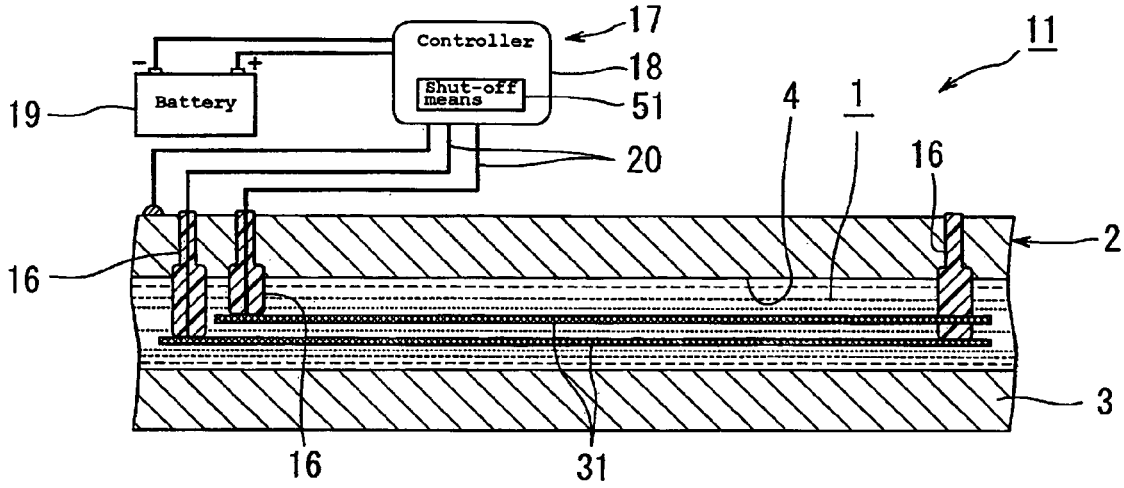
FIG. 9 is a schematic, cross-section of the impressed current cathodic protection system illustrated in FIG. 8.

FIG. 8 is a block diagram illustrating another embodiment of an impressed current cathodic protection system 11 that includes redundant or plural electrodes 31. FIG. 9 is a schematic, cross-section of the impressed current cathodic protection system 11 illustrated in FIG. 8.

Figure 10:
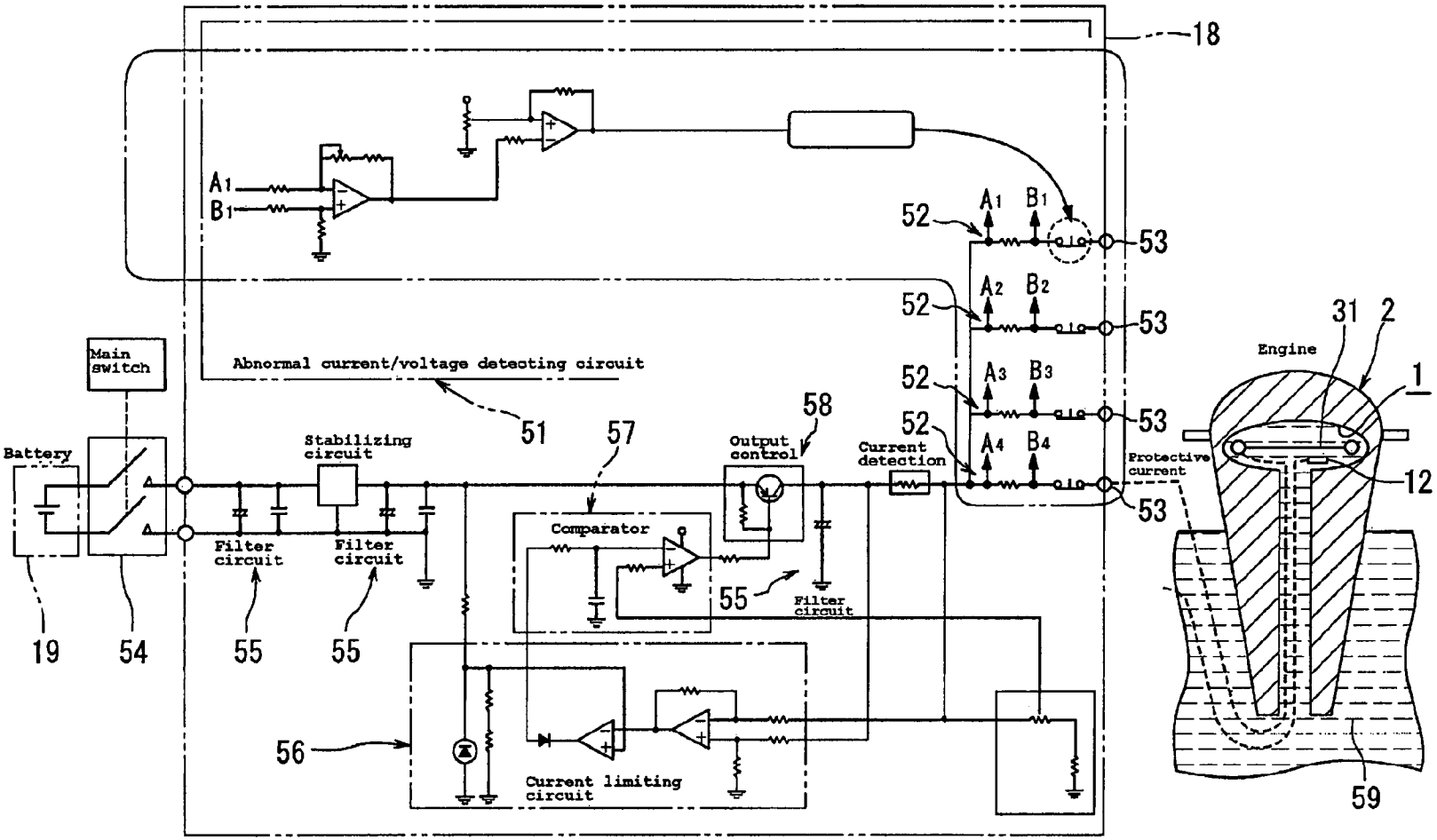
FIG. 10 is a circuit diagram of the controller illustrated in FIG. 9.

The embodiment illustrated in FIGS. 8 through 10 includes a plurality of anticorrosive electrodes 31. Protective current flows to each anticorrosive electrode 31 through the controller 18.

FIG. 10 is a circuit diagram of the controller 18 illustrated in FIG. 9. As shown in FIG. 10, the controller 18 illustrated in FIGS. 8 and 9 may include various circuits. In the illustrated embodiment, the controller 18 includes an abnormal current/voltage detecting circuit 51, a power switch 54, a filter circuit 55, a current limiting circuit 56, a comparator 57, and an output control circuit 58. The controller 18 may further include four output terminals 53 connected to the four anticorrosive electrodes 31. Each output terminal 53 may correspond to a power supply circuit 52 and to an abnormal current/voltage detecting circuit 51.

The abnormal current/voltage detecting circuit 51 automatically shuts-off the power supplying circuits to the anticorrosive electrodes 31 if a short circuit occurs. For example, a short circuit may occur if any of the electrodes 31 contacts the engine 2. In this case, the abnormal current/voltage detecting circuit 51 automatically stops the supply of power to the short-circuited anticorrosive electrode 31. The rest of the anticorrosive electrodes 31, 31 can thus continue to be supplied with a protective current despite the short circuit. The abnormal current/voltage detecting circuit 51 shuts-off the power supply circuits 52 to the anticorrosive electrodes 31 when a current flowing through the anticorrosive electrodes 31 exceeds a predetermined value.

As shown in FIG. 9, with the plurality of electrodes 31 disposed at the same position in the coolant channel 1, a redundant electrode 31 provides corrosion protection even the other electrode 31 fails. The remaining anticorrosive electrode 31 continues to flow the protective current through the short-circuited portion to provide protection to that portion. In this way, the area affected by the failed or short-circuited electrode 31 is minimized.

The power switch 54 switches the controller 18 ON/OFF and is operatively connected to an engine switch or main switch. During engine 2 operation with the coolant passage 1 supplied with seawater 59, the power supply is ON for the anticorrosive electrodes 31. When the engine 2 stops and a majority of the coolant is drained from the engine 2, the power supply is OFF. By turning the impressed current cathodic protection system 11 off when the engine 2 is not in use, power consumption is reduced.

For embodiments of the controller 18 that include the abnormal current/voltage detecting circuit 51, any of the three power supply methods described above with reference to FIG. 2 may be employed.

Figure 11:
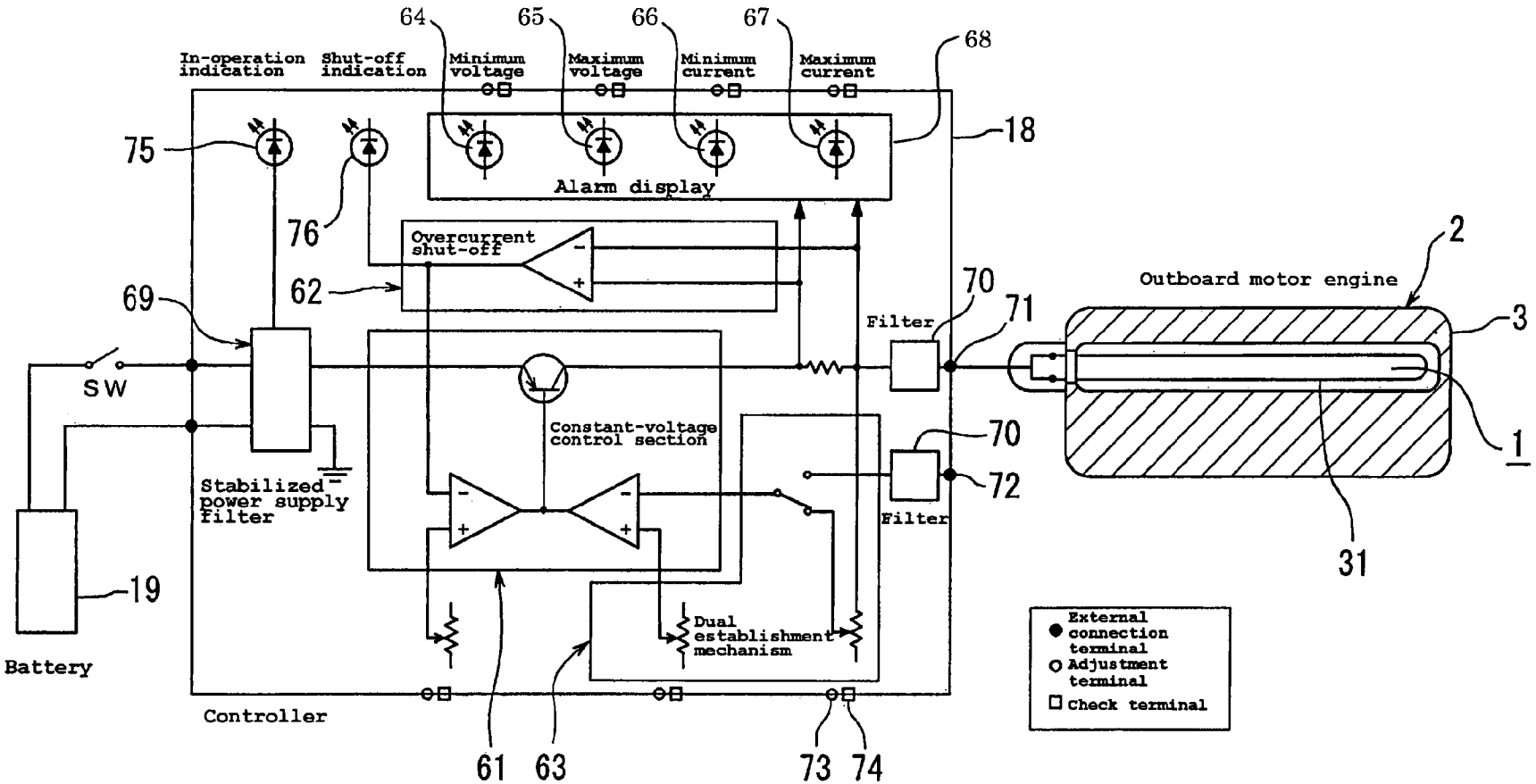
FIG. 11 is a circuit diagram of a controller employing a constant-voltage method with the power supply.

FIG. 11 is a circuit diagram of a controller 18 employing a constant-voltage method for the power supply. The controller 18 illustrated in FIG. 11 includes a constant-voltage control section 61, an over current shut-off section 62, a dual establishment mechanism 63, an alarm display section 68, a stabilized power supply filter 69, and an output-side filter 70. Terminal 71 is a connection location for the anticorrosive electrodes 31. Reference electrode terminal 72 is a connection location for a reference electrode if a potential control method is selected. Terminal 73 is an adjustment terminal. Terminal 74 is a check terminal.

The constant-voltage control section 61 maintains a voltage applied to the anticorrosive electrodes 31. The over-current shut-off section 62 stops the supply of power to the anticorrosive electrodes 31 when an over-current flows through the anticorrosive electrodes 31. The dual establishment mechanism 63 monitors the supply of power to the anticorrosive electrodes 31.

The alarm display section 68 may include a plurality of LEDs 64, 65, 66, 67 for notifying an operator of an alarm condition. The alarm section 68 may provide an audible alarm to the operator. For example, a circuit may light the LED 64 in response to a drop in the voltage applied to the anticorrosive electrodes 31 to a level below a predetermined minimum value. A circuit may light the LED 65 in response to a voltage exceeding a predetermined maximum value. A circuit may light the LED 66 in response to a drop in the current flowing through the anticorrosive electrodes 31 to a level below a predetermined minimum value. A circuit may light the LED 67 in response to the current exceeding a predetermined maximum value.

The controller 18 may further include an LED 75 and LED 76. The LED 75 may be configured to light up when current is being supplied to the stabilized power supply filter 69. The LED 76 may be configured to light up when the over-current shut-off section 62 stops the supply of power to the anticorrosive electrodes 31.

When the voltage or current being supplied to the anticorrosive electrodes 31 excessively increases/decreases or is not within a normal range, the associated LED 64, 65, 66, 67 lights up so as to inform a driver of the occurrence of the abnormality. As described above, the designs of the cathodic protection system 11 allow preventive inspections and repairs to be performed on the cathodic protection system 11. By designing the cathodic protection system 11 in this manner, these repairs and inspections may prevent additional corrosion from occurring after an abnormality is detected by the controller 18.

An advantage of the cathodic protection system is less that space is needed to fix the electrodes to the engine as compared to fixing a conventional cathodic protection system that has a number of bar-shaped sacrificial electrodes. Moreover, the cathodic protection system of the invention uses fewer electrodes as compared to a conventional cathodic protection system that has bar-shaped sacrificial electrodes. The engine manufacturing costs for the cathodic protection system of the invention are less than the costs for assembling an engine employing a conventional cathodic protection system.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. An impressed current cathodic protection system for a marine engine having a wall that forms a coolant passage, the coolant passage being configured to receive a conductive coolant, the system comprising:

a plurality of electrodes, at least a portion of each electrode being disposed in the coolant passage, each electrode being electrically insulated from the wall;

a power supply configured to provide a protective current between the plurality of electrodes and the engine via the conductive coolant; and an electrical conductor insulated from the engine and the conductive coolant, said conductor electrically coupling the power supply to at least two of said plurality of electrodes, said coupling occurring at a point insulated from the conductive coolant.

2. The system according to claim 1, wherein the power supply device comprises a controller regulating the protective current so as to generally maintain a potential difference between the electrodes and the engine.

3. The system according to claim 1, wherein at least one of the plurality of electrodes has a linear form.

4. The system according to claim 3, wherein the shape of each of the electrodes generally conforms to a shape of a section of the coolant passage in which such electrode is disposed.

5. The system according to claim 1, wherein at least one of the plurality of electrodes has a loop form.

6. The system according to claim 1, wherein at least one of each of electrodes is connected to the power supply.

7. The system according to claim 1, wherein the plurality of electrodes is arranged side by side,

8. The system according to claim 1, wherein the power supply comprises a circuit for automatically shutting off one of the plurality of electrodes upon the occurrence of a short circuit to the one of the plurality of electrodes.

9. The system according to claim 1, wherein the power supply comprises a switch disconnecting power to the electrode when the engine is stopped.

10. The system according to claim 1, further comprising:

an abnormality detection circuit for detecting an abnormality in the power supply to the plurality of electrodes; and an alarm circuit for producing an alarm in response to the detection of an abnormality.

11. A marine engine comprising:

a wall forming a coolant passage configured to receive a conductive coolant;

a plurality of electrodes, at least a portion of each electrode being disposed in the coolant passage, each electrode being electrically insulated from the wall;

a power supply configured to supply an electric potential between the plurality of electrodes and the engine; and an electrical conductor insulated from the engine and the conductive coolant, said conductor electrically coupling the power supply to at least two of said plurality of electrodes, said coupling occurring outside the coolant passage.

12. The marine engine according to claim 11, wherein the plurality of electrodes is configured to provide a protective current to the engine via the conductive coolant, and wherein the power supply is configured to control the protective current so as to generally maintain the electric potential between the plurality of electrodes and the engine.

13. The marine engine according to claim 12, wherein the plurality of electrodes provide the protective current through a wall of the coolant passage in the engine.

14. The marine engine according to claim 12 further comprising a reference electrode, wherein the power supply is configured to control the protective current so as to generally maintain the electric potential between the plurality of electrodes and the engine based at least in part on a measured potential between the reference electrode and the engine.

15. The marine engine according to claim 11, wherein a shape of at least one of the plurality of electrodes generally conforms to a shape of a portion of the coolant passage in which such electrode is disposed.

16. The marine engine according to claim 11 further comprising a shut-off circuit configured to shut off the electric potential in response to at least one of the plurality of electrodes short circuiting.

17. The marine engine according to claim 11, further comprising an abnormality detection circuit configured to detect abnormalities in the electric potential.

18. The marine engine according to claim 11, wherein the power supply is configured to generally maintain a constant voltage between the plurality of electrodes and the engine.

19. The marine engine according to claim 11, wherein the power supply is configured to generally maintain a constant current between the plurality of electrodes and the engine.

20. The marine engine according to claim 11 additionally having a crankshaft oriented to rotate about a generally vertical axis.

* * * * *